US012331740B2

(12) United States Patent
Goy et al.

(10) Patent No.: US 12,331,740 B2
(45) Date of Patent: Jun. 17, 2025

(54) VARIABLE DISPLACEMENT PUMPS

(71) Applicant: Hamilton Sundstrand Corporation, Charlotte, NC (US)

(72) Inventors: Edward W. Goy, Crystal Lake, IL (US); Zachary Allen Ray Le Duc, Rockford, IL (US); Mark W. Shoemaker, Pecatonica, IL (US); Mason Rosenberg, Loves Park, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 18/075,199

(22) Filed: Dec. 5, 2022

(65) Prior Publication Data

US 2024/0183345 A1 Jun. 6, 2024

(51) Int. Cl.

| | |
|---|---|
| ***F04B 9/02*** | (2006.01) |
| ***F04B 19/22*** | (2006.01) |
| ***F04B 53/14*** | (2006.01) |

(52) U.S. Cl.

CPC ..... *F04B 9/02* (2013.01); *F04B 19/22* (2013.01); *F04B 53/14* (2013.01); *F04B 53/144* (2013.01)

(58) Field of Classification Search

CPC ..... F04B 1/146; F04B 1/295; F04B 1/322; F04B 1/324; F04B 27/1054; F04B 53/14; F04B 53/143; F03C 1/0686; F03C 1/0631; F01B 3/102; F01B 3/105; F01B 3/106; F15B 2211/20553

See application file for complete search history.

(56) References Cited

U.S. PATENT DOCUMENTS

| | | | | |
|---|---|---|---|---|
| 2,997,318 A * | 8/1961 | Lansky | ..... | F16J 15/3236 277/565 |
| 3,191,264 A * | 6/1965 | Underwood | ..... | F16C 11/0619 29/898.044 |
| 6,398,528 B1 | 6/2002 | Hansen et al. | | |
| 8,128,378 B2 | 3/2012 | Rowan et al. | | |
| 8,348,630 B2 | 1/2013 | Tysver et al. | | |
| 9,234,464 B2 | 1/2016 | Benson | | |
| 2020/0003191 A1 | 1/2020 | Ono et al. | | |

FOREIGN PATENT DOCUMENTS

| | | | | |
|---|---|---|---|---|
| JP | S58176480 A | 10/1983 | | |
| JP | H1122632 A * | 1/1999 | ..... | F01B 3/02 |
| JP | 2017203399 A * | 11/2017 | ..... | F04B 1/26 |

OTHER PUBLICATIONS

Extended European Search Report for European Patent Application No. 23214782.7, Dated Jun. 4, 2024, 12 Pages.

* cited by examiner

*Primary Examiner* — Kenneth J Hansen
(74) *Attorney, Agent, or Firm* — Kinney & Lange, P.A.

(57) ABSTRACT

A variable displacement pump system can include a piston sleeve having at least a first inner diameter portion and a second in inner diameter portion and an actuator piston configured to be disposed within the piston sleeve. The actuator piston can have a first piston portion having a first outer diameter, and a second piston portion having a second outer diameter. The first outer diameter can be different than the second outer diameter. The first piston portion can be configured to seal to the first inner diameter portion of the piston sleeve. The second piston portion of the actuator piston can be configured to seal to the second inner diameter portion of the piston sleeve.

16 Claims, 2 Drawing Sheets

VARIABLE DISPLACEMENT PUMPS

FIELD

This disclosure relates to variable displacement pumps.

BACKGROUND

Current variable displacement pumps utilize an actuator piston with a single seal. The actuator piston has a pressure fed by discharge from the pump, perhaps compensated or regulated by an electro-hydraulic servo valve (EHSV) and/or a compensation or regulating valve. The response rate of a pump of this type is then dependent on the size of the actuator piston and the size of return springs.

Such conventional methods and systems have generally been considered satisfactory for their intended purpose. However, there is still a need in the art for improvements. The present disclosure provides a solution for this need.

SUMMARY

In accordance with at least one aspect of this disclosure, a variable displacement pump system can include a piston sleeve having at least a first inner diameter portion and a second inner diameter portion and an actuator piston configured to be disposed within the piston sleeve. The actuator piston can have a first piston portion having a first outer diameter, and a second piston portion having a second outer diameter. The first outer diameter can be different than the second outer diameter. The first piston portion can be configured to seal to the first inner diameter portion of the piston sleeve. The second piston portion of the actuator piston can be configured to seal to the second inner diameter portion of the piston sleeve.

In certain embodiments, the first piston portion of the actuator piston and the first inner diameter portion of the piston sleeve define a first pressure volume. The first piston portion and second piston portion of the actuator piston and the first inner diameter portion and the second inner diameter portion of the piston sleeve can define a second pressure volume. In certain embodiments, the piston sleeve can include a first port in fluid communication with the first pressure volume and a second port in fluid communication with the second pressure volume. In certain embodiments, the first outer diameter can be smaller than the second outer diameter.

In certain embodiments, an actuator rod can be operatively connected to the second piston portion of the actuator piston via a ball joint. The actuator rod can be configured to connect to a tilting mechanism of a variable displacement pump. A rod connection side of the second piston portion of the actuator piston can be configured to be exposed to a pump inlet pressure.

In certain embodiments, the actuator can be top-hat shaped. Any suitable other shape in accordance with this disclosure is contemplated herein.

In certain embodiments, the piston sleeve can have a third inner diameter portion different than the second inner diameter. The actuator piston can further include a third piston portion having a third outer diameter. The third piston portion can be configured to seal to the third inner diameter portion of the piston sleeve. In certain embodiments, the third inner diameter portion can be smaller than the second inner diameter portion. The third outer diameter can be smaller than the first outer diameter, for example. In certain embodiments, the third inner diameter portion can be the same diameter as the first inner diameter portion. In certain embodiments, the third outer diameter can be the same as the first outer diameter, for example.

In certain embodiments, the first piston portion of the actuator piston and the first inner diameter portion of the piston sleeve can define a first pressure volume. The first piston portion and second piston portion of the actuator piston and the first inner diameter portion and the second inner diameter portion of the piston sleeve can define a second pressure volume. The third piston portion and second piston portion of the actuator piston and the third inner diameter portion of the piston sleeve can define a third pressure volume.

In certain embodiments, the piston sleeve can include a first port in fluid communication with the first pressure volume and a second port in fluid communication with the second pressure volume. In certain embodiments, the piston sleeve can include a third port in fluid communication with the third pressure volume.

In certain embodiments, the actuator rod can be operatively connected to the third piston portion of the actuator via a ball joint. In certain embodiments, a rod connection side of the third piston portion of the actuator piston can be configured to be exposed to a pump inlet pressure. In certain embodiments, the third inner diameter portion can form a standoff to limit a position of the actuator piston.

In certain embodiments, the actuator piston can include a plurality of glands defined therein and configured to receive one or more seals. The plurality of glands can include at least one gland defined on each portion of the actuator piston, for example.

In certain embodiments, the variable displacement pump system can further include an electro-hydraulic servo valve (EHSV) configured to provide controlled pressure to one or more of the ports. In certain embodiments, the EHSV can be operatively connected to the first port to provide a first controlled pressure to the first port and operatively connected to the second port to provide a second controlled pressure to the second port. In certain embodiments, the EHSV can be operatively connected to the second port to provide a controlled pressure to the second port. In certain embodiments, the first port can be configured to be connected to a pump discharge pressure.

In accordance with at least one aspect of this disclosure, an actuator piston assembly for a variable displacement pump can include an actuator piston and a piston sleeve. The actuator piston and the piston sleeve can be configured to define at least a first pressure volume and a second pressure volume therebetween. The first pressure volume can be in fluid communication with a first pressure port. The second pressure volume can be in fluid communication with a second pressure port. A position and/or rate of movement of the actuator piston within the piston sleeve can be controllable as a function of a first pressure applied to the first pressure port and a second pressure applied to the second pressure port.

In accordance with at least one aspect of this disclosure, a non-transitory computer readable medium can include computer executable instructions configured to cause a computer to perform a method. The method can include controlling a pressure provided to a plurality of ports of an actuator piston assembly of a variable displacement pump to control a slew rate of an actuator piston. In certain embodiments, controlling the pressure can include controlling an electrohydraulic servo valve (EHSV) connected to at least one of the plurality of ports. The method can include any other suitable method(s) and/or portion(s) thereof.

In accordance with at least one aspect of this disclosure, an actuator piston assembly can be configured to allow slew rate control and/or position control as a function of a plurality of pressures applied to an actuator piston of the piston assembly within an piston sleeve of the piston assembly. The actuator piston assembly can include any other suitable components disclosed herein.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
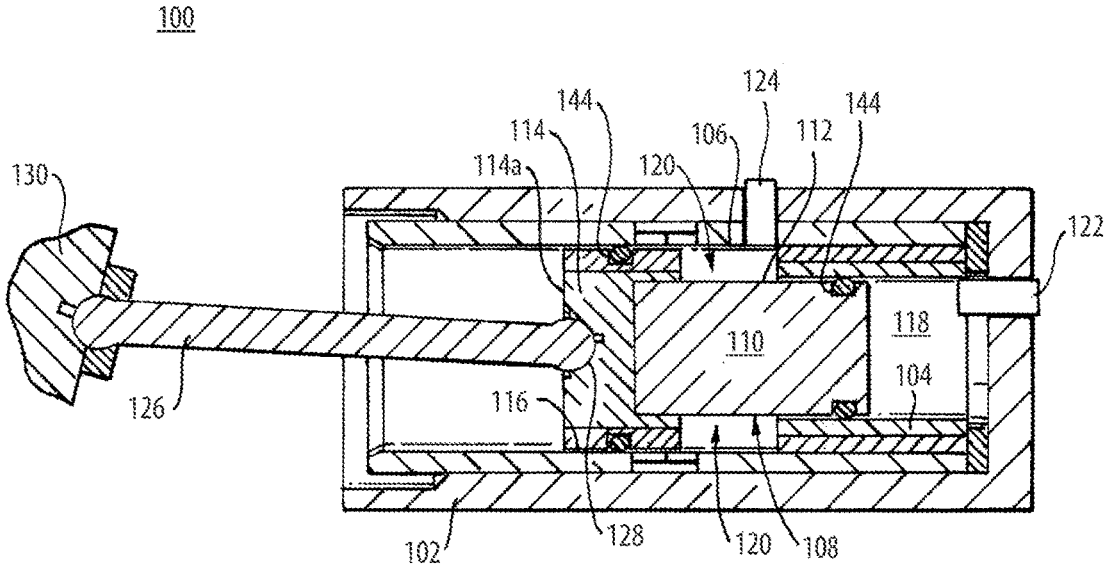
FIG. 1 is a side cross-section view of an embodiment of a variable displacement pump system in accordance with this disclosure.
Figure 2:
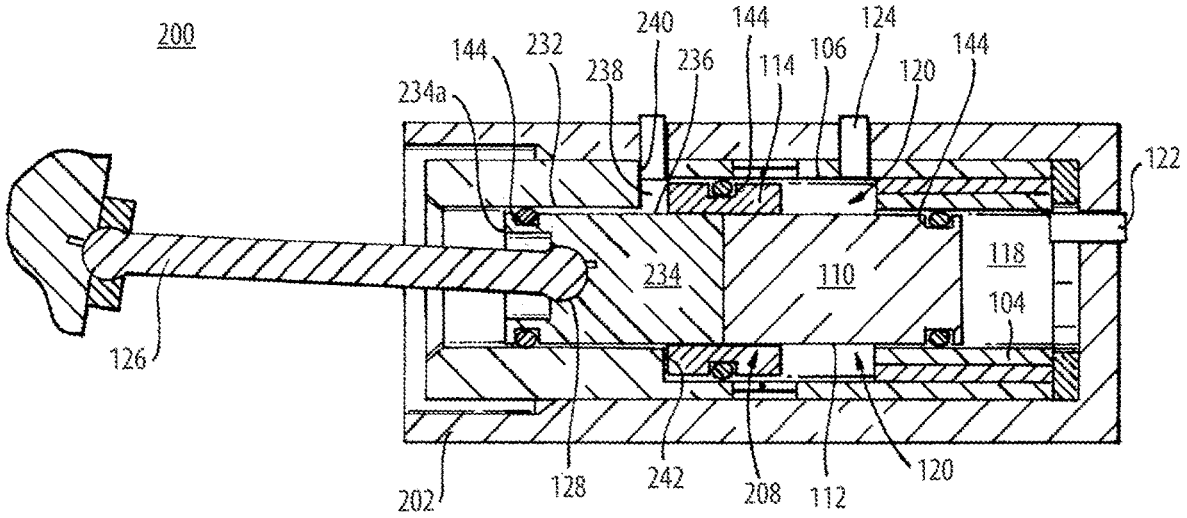
FIG. 2 is a side cross section view of an embodiment of a variable displacement pump system in accordance with this disclosure.
Figure 3:
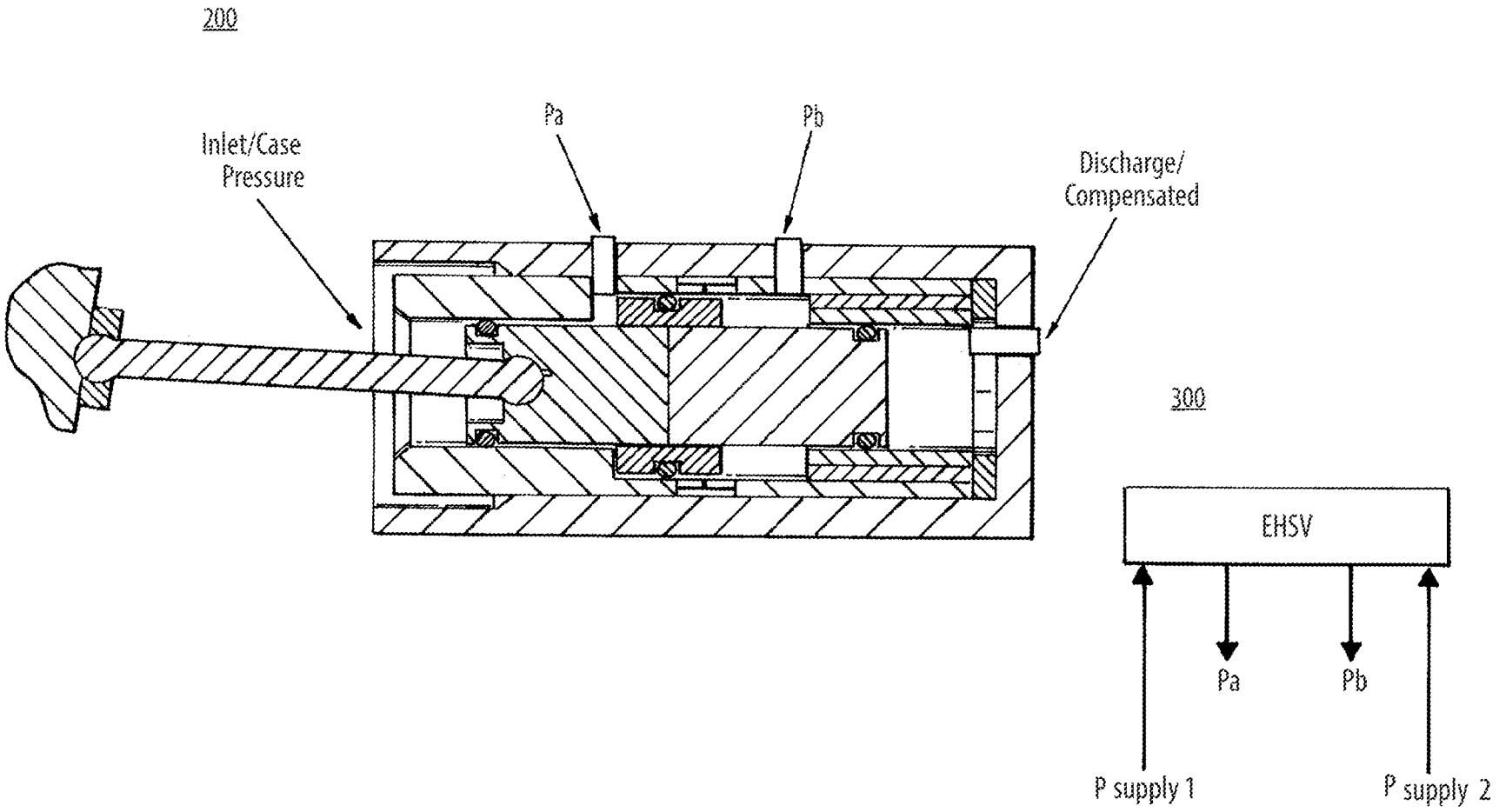
FIG. 3 is a schematic view of the embodiment of FIG. 2, shown schematically connected to an embodiment of an electrohydraulic servo valve (EHSV) having a four-way arrangement in accordance with this disclosure.

Reference will now be made to the drawings wherein like reference numerals identify similar structural features or aspects of the subject disclosure. For purposes of explanation and illustration, and not limitation, an illustrative view of an embodiment of a variable displacement pump system in accordance with the disclosure is shown in FIG. 1 and is designated generally by reference character 100. Other embodiments and/or aspects of this disclosure are shown in FIGS. 2-3. Certain embodiments described herein can be used to control slew rate of an actuator piston, for example (e.g., for a variable displacement pump).

In accordance with at least one aspect of this disclosure, referring to FIG. 1, a variable displacement pump system 100 can include a piston sleeve 102 having at least a first inner diameter portion 104 and a second in inner diameter portion 106. The pump system 100 can also include an actuator piston 108 configured to be disposed within the piston sleeve 102 (e.g., to control displacement of a variable displacement pump).

The actuator piston 108 can have a first piston portion 110 having a first outer diameter 112, and a second piston portion 114 having a second outer diameter 116. The first outer diameter 112 can be different than the second outer diameter 116. The first piston portion 110 can be configured to seal (e.g., via a seal) to the first inner diameter portion 104 of the piston sleeve 102. The second piston portion 114 of the actuator piston 108 can be configured to seal (e.g., via a seal) to the second inner diameter portion 106 of the piston sleeve 102, for example.

In certain embodiments, the first piston portion 110 of the actuator piston 108 and the first inner diameter portion 104 of the piston sleeve 102 define a first pressure volume 118. The first piston portion 110 and second piston portion 114 of the actuator piston 108 and the first inner diameter portion 104 and the second inner diameter portion 106 of the piston sleeve 102 define a second pressure volume 120. In certain embodiments, the piston sleeve 102 can include a first port 122 in fluid communication with the first pressure volume 118 and a second port 124 in fluid communication with the second pressure volume 120.

In certain embodiments, e.g., as shown, the first outer diameter 112 can be smaller than the second outer diameter 116. For example, the actuator 108 can be top-hat shaped. Such a stepped shape of the sleeve 102 and/or top hat configuration of the actuator piston 108 can provide for intermediate pressure control locations within the variable displacement pump system, for example.

In certain embodiments, an actuator rod 126 can be operatively connected to the second piston portion 114 of the actuator piston 108 via a ball joint 128. The actuator rod 126 can be configured to connect to a tilting mechanism 130 of a variable displacement pump. The tilting mechanism 130 can include a spring mechanism configured to bias the actuator piston 108 (e.g., toward the maximum displacement position). In certain embodiments, the ball joint 128 can be kept engaged to the actuator piston 108 by the biasing force from the tilting mechanism 130 and is not otherwise connected to the actuator piston 108. In certain embodiments, a rod connection side 114*a* of the second piston portion 114 of the actuator piston 108 can be configured to be exposed to a pump inlet pressure, for example.

In certain embodiments, referring to the embodiment of a system 200 of FIG. 2, the piston sleeve 202 can have a third inner diameter portion 232 different than the second inner diameter portion 106. The actuator piston 208 can further include a third piston portion 234 having a third outer diameter 236. The third piston portion 234 can be configured to seal (e.g., via a seal such as an o-ring) to the third inner diameter portion 232 of the piston sleeve 202. In certain embodiments, the third inner diameter portion 232 can be smaller than the second inner diameter portion 106. The third outer diameter 236 can be smaller than the first outer diameter 112. In certain embodiments, the third inner diameter portion 232 can be the same diameter as the first inner diameter portion 104. The third outer diameter 236 can be the same as the first outer diameter 112.

In certain embodiments, the first piston portion 110 of the actuator piston 208 and the first inner diameter portion 104 of the piston sleeve 202 can define a first pressure volume 118. The first piston portion 110 and second piston portion 114 of the actuator piston 208 and the first inner diameter portion 104 and the second inner diameter portion 106 of the piston sleeve 202 can define a second pressure volume 120. The third piston portion 234 and second piston portion 114 of the actuator piston 208 and the third inner diameter portion 232 of the piston sleeve 202 can define a third pressure volume 238.

In certain embodiments, the piston sleeve 202 can include a first port 122 in fluid communication with the first pressure volume 118 and a second port 124 in fluid communication with the second pressure volume 120. The piston sleeve 202 can include a third port 240 in fluid communication with the third pressure volume 238.

In certain embodiments, the actuator rod 126 can be operatively connected to the third piston portion 234 of the actuator 208 via a ball joint 128. In certain embodiments, a rod connection side 234*a* of the third piston portion 234 of the actuator piston 208 can be configured to be exposed to a pump inlet pressure, for example.

In certain embodiments, the third inner diameter portion 232 can form a standoff 242 to limit a position of the actuator piston 208. The standoff 242 can be configured to limit motion of the piston actuator 208 and allow the third port 240 to be functional in a minimum displacement position (e.g., as shown in FIG. 2).

In certain embodiments, referring to FIGS. 1 and 2, the actuator piston 108, 208 can include a plurality of glands 144 defined therein and configured to receive one or more seals (e.g., one or more o-rings, not shown). For example, the plurality of glands 144 can be pockets configured to receive one or more o-ring seals. The plurality of glands 144 can include at least one gland defined on each portion of the actuator piston 108, 208. The actuator piston 108, 208 can have multiple seals around the outer diameter to seal off different locations which can have different pressure fluid ported to the different locations to allow for a more precise and/or rapid control over the displacement of the variable displacement pump.

In accordance with at least one aspect of this disclosure, referring additionally to FIG. 3, the variable displacement pump system can further include an electrohydraulic servo valve (EHSV) 300 configured to provide controlled pressure to one or more of the ports 122, 124, 240. In certain embodiments, e.g., in the system 100 of FIG. 1, the EHSV 300 can be operatively connected to the first port 122 to provide a first controlled pressure to the first port 122 and operatively connected to the second port 124 to provide a second controlled pressure to the second port 124. In certain embodiments, the EHSV 300 can be operatively connected to the second port 124 to provide a controlled pressure to the second port 124 only, for example. The first port 122 can be configured to be connected to a pump discharge pressure (e.g., controlled by a valve to be on or off, and/or compensated).

In certain embodiments, e.g., as shown for the system 200 in FIG. 3, the EHSV 300 can be operatively connected to the second port 124 and the third port 240 to control the pressures thereto, and the first port 122 can be connect to a pump discharge pressure (e.g., controlled by a valve to be on or off, and/or compensated). In certain embodiments, the EHSV 300 can include three outlet lines and can be connected to all ports 122, 124, 240 to control pressure at each location. The EHSV 300 can include a first supply pressure (Psupply 1) and a second supply pressure (Psupply2) and can be configured to output any pressure (e.g., Pa on a first line, Pb on a second output line) including and between those two pressures, independently on each output line, for example.

Certain embodiments allow for the use of a four-way EHSV (e.g., having two independently controlled output lines as shown in FIG. 3). The four-way EHSV can provide pressure control stability, for example. Certain embodiments allow for a five-way EHSV (e.g., three output lines) to further allow for more slew rate control.

In accordance with at least one aspect of this disclosure, an actuator piston assembly for a variable displacement pump can include an actuator piston and a piston sleeve. The actuator piston and the piston sleeve can be configured to define at least a first pressure volume and a second pressure volume therebetween. The first pressure volume can be in fluid communication with a first pressure port. The second pressure volume can be in fluid communication with a second pressure port. A position and/or rate of movement of the actuator piston within the piston sleeve can be controllable as a function of a first pressure applied to the first pressure port and a second pressure applied to the second pressure port. The actuator piston assembly can be or include any suitable system or portion thereof disclosed herein, e.g., systems 100, 200 as described above.

In accordance with at least one aspect of this disclosure, a non-transitory computer readable medium, comprising computer executable instructions can be configured to cause a computer to perform a method. The method can include controlling a pressure provided to a plurality of ports of an actuator piston assembly of a variable displacement pump to control a slew rate of an actuator piston. In certain embodiments, controlling the pressure can include controlling an electrohydraulic servo valve (EHSV) connected to at least one of the plurality of ports.

Control of the actuator piston via the first and second ports can be the result of discharge pressure and/or a pre-selected inserted pressure (Pa or Pb). The actuator piston can be controlled to provide fast piston movement and/or fine tuned piston movement. In certain embodiments, the discharge pressure (e.g., which is a relatively fixed pressure) can be used to push on one side. In such a case, one or more pressures from an EHSV (e.g., Pa and/or Pb) can be used to control the slew rate of the actuator piston more precisely.

Certain embodiments can provide for a number of ways to control the actuator piston to provide for fast movement or fine tuned movement. For example, a control pressure (e.g., Pb) can be selected to provide force balance with an inlet pressure. For example, the pressure difference acting on the actuator piston is a function of the area of each side of actuator piston and the pressure acting thereon. For example, as shown in FIG. 1, the inlet pressure side (e.g., side 114*a*) is larger and the inner diameter portion side is smaller so the pressure on the first port can be a larger pressure than the inlet pressure to balance the forces). The second port and/or third port can then be used to allow for fine tuned movements of the actuator piston.

In a fast motion scheme, all ports can have high or low pressure to allow the actuator piston to move quickly. When moving to maximum displacement (right), the spring on the tilt mechanism can push the actuator piston and define the maximum slew rate (e.g., in the embodiment of FIG. 1). When moving to minimum displacement (left) the pressures on the first port and the second port are pushing against spring and inlet pressure and define the slew rate.

To assist with more rapid adjustments of displacement, a multi-pressure actuation piston can be utilized. The different pressure zones, e.g., volumes 118, 120, 238 acting on the actuator pistons 108, 208 can allow for more control over the displacement of the variable displacement pump system and more rapid transients. In certain embodiments, e.g., as shown in FIGS. 2 and 3, the ball joint 128 can be bolted or otherwise retained (e.g., a ball joint assembly that still allows the ball to rotate but not come out axially) in the event that the slew rate back to maximum displacement (e.g., to the right as shown) is faster than the spring rate from the tilt assembly.

Certain embodiments can include min-to-max displacement fluid pressure ported to a back-side of the actuator piston. For example, embodiments can include optional porting from one of the EHSV control port 3 (Pa) or 4 (Pb) to allow for quicker dynamic response from maximum displacement to minimum displacement. Certain embodiments can utilize compensated pressure, discharge pressure, or EHSV control port 3 (Pa) pressure for example. Certain embodiments can include an additional stepped portion of the actuator piston sleeve only on the right side as shown, and one additional o-ring gland on the actuator piston.

Certain embodiments can include min-to-max displacement fluid pressure ported to a back-side of the actuator piston. Certain embodiments can include porting from the EHSV control port 3 (Pa) to allow for quicker dynamic response from minimum displacement to maximum displacement. This configuration can include an additional stepped portion of the actuator piston sleeve on both the right and left sides as shown, e.g., in FIG. 2. Certain embodiments can include two additional o-ring glands on the actuator piston, and an actuator piston rod retention method (e.g., bolted retainer into the actuator piston to attach the rod to the piston and allow the piston to pull on the rod and pump pivot assembly).

Embodiments can include any suitable computer hardware and/or software module(s) to perform any suitable function (e.g., as disclosed herein). As will be appreciated by those skilled in the art, aspects of the present disclosure may be embodied as a system, method or computer program product. Accordingly, aspects of this disclosure may take the form of an entirely hardware embodiment, an entirely software embodiment (including firmware, resident software, micro-code, etc.), or an embodiment combining software and hardware aspects, all possibilities of which can be referred to herein as a "circuit," "module," or "system." A "circuit," "module," or "system" can include one or more portions of one or more separate physical hardware and/or software components that can together perform the disclosed function of the "circuit," "module," or "system", or a "circuit," "module," or "system" can be a single self-contained unit (e.g., of hardware and/or software). Furthermore, aspects of this disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of this disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of this disclosure may be described above with reference to flowchart illustrations and/or block diagrams of methods, apparatus (systems) and computer program products according to embodiments of this disclosure. It will be understood that each block of any flowchart illustrations and/or block diagrams, and combinations of blocks in any flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in any flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A variable displacement pump system, comprising:

a piston sleeve having at least a first inner diameter portion, a second inner diameter portion, and a third inner diameter portion, wherein the third inner diameter portion is different in size than the second inner diameter portion;

an actuator piston configured to be disposed within the piston sleeve, the actuator piston having:

a first piston portion having a first outer diameter;

a second piston portion having a second outer diameter, wherein the first outer diameter is different than the second outer diameter, wherein the first piston portion is configured to seal to the first inner diameter portion of the piston sleeve, and wherein the second piston portion of the actuator piston is configured to seal to the second inner diameter portion of the piston sleeve; and a third piston portion having a third outer diameter, wherein the third piston portion is configured to seal to the third inner diameter portion of the piston sleeve, and wherein the first piston portion of the actuator piston and the first inner diameter portion of the piston sleeve define a first pressure volume, wherein the first piston portion and second piston portion of the actuator piston and the first inner diameter portion and the second inner diameter portion of the piston sleeve define a second pressure volume, and wherein the third piston portion and second piston portion of the actuator piston and the third inner diameter portion of the piston sleeve define a third pressure volume.

2. The variable displacement pump system of claim 1, wherein the piston sleeve includes a first port in fluid communication with the first pressure volume and a second port in fluid communication with the second pressure volume.

3. The variable displacement system of claim 1, wherein the first outer diameter is smaller than the second outer diameter.

4. The variable displacement pump system of claim 1, further comprising an actuator rod operatively connected to the third piston portion of the actuator piston via a ball joint, wherein the actuator rod is configured to connect to a tilting mechanism of a variable displacement pump, wherein a rod connection side of the third piston portion of the actuator piston is configured to be exposed to a pump inlet pressure.

5. The variable displacement system of claim 1, wherein the third inner diameter portion is smaller than the second inner diameter portion, wherein the third outer diameter is smaller than the first outer diameter.

6. The variable displacement system of claim 1, wherein the third inner diameter portion is the same diameter as the first inner diameter portion, wherein the third outer diameter is the same as the first outer diameter.

7. The variable displacement pump system of claim 1, wherein the piston sleeve includes a first port in fluid communication with the first pressure volume and a second port in fluid communication with the second pressure volume, wherein the piston sleeve includes a third port in fluid communication with the third pressure volume.

8. The variable displacement system of claim 7, further comprising an actuator rod operatively connected to the third piston portion of the actuator via a ball joint, wherein the actuator rod is configured to connect to a tilting mechanism of a variable displacement pump, and wherein a rod connection side of the third piston portion of the actuator piston is configured to be exposed to a pump inlet pressure.

9. The variable displacement pump of claim 1, wherein the third inner diameter portion forms a standoff to limit a position of the actuator piston.

10. The variable displacement pump system of claim 1, wherein the actuator piston includes a plurality of glands defined therein and configured to receive one or more seals, wherein the plurality of glands include at least one gland defined on each portion of the actuator piston.

11. The variable displacement pump system of claim 2, further comprising an electro-hydraulic servo valve (EHSV) configured to provide controlled pressure to one or more of the ports.

12. The variable displacement pump system of claim 11, wherein the EHSV is operatively connected to the first port to provide a first controlled pressure to the first port and operatively connected to the second port to provide a second controlled pressure to the second port.

13. The variable displacement pump system of claim 11, wherein the EHSV is operatively connected to the second port to provide a controlled pressure to the second port, wherein the first port is configured to be connected to a pump discharge pressure.

14. An actuator piston assembly for a variable displacement pump, comprising:

a piston sleeve comprising:

a first inner diameter portion;

a second inner diameter portion; and a third inner diameter portion, wherein the second inner diameter portion is positioned between the first inner diameter portion and the third inner diameter portion, and wherein the third inner diameter portion is different in size than the second inner diameter;

an actuator piston disposed within the piston sleeve, the actuator piston comprising:

a first piston portion comprising a first outer diameter;

a second piston portion having a second outer diameter; and a third piston portion comprising a third outer diameter, wherein the second piston portion is positioned between the third piston portion and the first piston portion, wherein the first piston portion and the first inner diameter portion define a first pressure volume, wherein the first piston portion, the second piston portion, the first inner diameter portion, and the second inner diameter portion define a second pressure volume, and wherein the third piston portion, the second piston portion, and the third inner diameter portion define a third pressure volume.

15. The actuator piston assembly of claim 14, further comprising:

a first seal between the first piston portion and the first inner diameter portion;

a second seal between the second piston portion and the second inner diameter portion; and a third seal between the third piston portion and the third inner diameter portion.

16. The actuator piston assembly of claim 14, further comprising:

a first port formed in the piston sleave and in fluid communication with the first pressure volume;

a second port formed in the piston sleave and in fluid communication with the second pressure volume; and a third port formed in the piston sleave and in fluid communication with the third pressure volume.

* * * * *